US007020904B2

(12) United States Patent
Chiang

(10) Patent No.: US 7,020,904 B2
(45) **Date of Patent: *Apr. 4, 2006**

(54) SWIMMING GOGGLES

(76) Inventor: Herman Chiang, 11F-2,NO,634-9, Ching-Ping Rd., Chung-Ho City, Taipei Hsien (TW)

( * ) Notice: Subject to any disclaimer, the term of this patent is extended or adjusted under 35 U.S.C. 154(b) by 205 days.

This patent is subject to a terminal disclaimer.

(21) Appl. No.: 10/610,921

(22) Filed: Jul. 2, 2003

(65) Prior Publication Data

US 2005/0015863 A1 Jan. 27, 2005

(51) Int. Cl.
*A61F 9/02* (2006.01)

(52) U.S. Cl. ..... 2/442

(58) Field of Classification Search ..... 2/426, 2/428, 440, 442

See application file for complete search history.

(56) References Cited

U.S. PATENT DOCUMENTS 6,023,791 A * 2/2000 Chiang ..... 2/441
6,505,352 B1 * 1/2003 Chiang ..... 2/428

* cited by examiner

*Primary Examiner*—Katherine M. Moran
(74) *Attorney, Agent, or Firm*—Troxell Law Office, PLLC

(57) ABSTRACT

A swimming goggles has left and right frames respectively accommodating lenses. A connecting frame is located between the left and the right frames. Head fasteners are respectively connected to outer sides of the left and right frames. Adjusting apparatuses are arranged between the head fasteners and the left and right frames. Each adjusting apparatus has a button with a biasing arm. The biasing arms unilaterally engage/disengage stopping slots of the head fasteners, whereas a user can directly pull the head fasteners to make the head fasteners tighter or press the button to make the head fasteners looser. The swimming goggles can be incrementally adjusted while being worn.

17 Claims, 5 Drawing Sheets

SWIMMING GOGGLES

BACKGROUND OF THE INVENTION

1. Field of the Invention

The present invention relates to swimming goggles, and more particularly to swimming goggles which have easily-adjustable head fasteners.

2. Related Art

It is inconvenient to adjust head fasteners of conventional swimming goggles during use. Conventional swimming goggles provide adjusting buttons for positioning and adjusting the head fasteners. Each adjusting button defines a pair of holes through which the head fasteners are pulled for positioning. During use the head fasteners cannot be adjusted, so the swimming goggles have to be taken off to adjust the head fasteners. Moreover, the head fasteners are difficult to adjust to a desired position.

Water leakage is another problem for the conventional swimming goggles. Inner sides of the frames of the conventional swimming goggles are subject to a connecting portion located between the frames leading to unclosed joint of pads of the swimming goggles and a concave between eyes and a nose, which results in water leakage. It is hard especially for customers with high nose bridges to overcome this problem.

SUMMARY OF THE INVENTION

An object of the present invention is to provide swimming goggles which are easily adjusted and perform optimally when worn and are incrementally adjustable.

Another object of the present invention is to provide swimming goggles which closely contact a concave located between a nose and eyes thereby avoiding water leakage.

The swimming goggles comprise adjusting apparatuses between a left and a right frames and head fasteners. Each adjusting apparatus comprises a button with a biasing arm for unilaterally engaging/disengaging a stopping slot of a head fastener, whereas a user can directly pull the head fasteners to make the head fasteners tighter or press the button to make the head fasteners looser.

A connecting frame connects the left and the right frames of the swimming goggles together. The connecting frame forms a pair of hoops surrounding outer edges of the swimming goggles, and a nose support extending inwardly from the hoops. The nose support is spaced a distance away from the inner sides of the hoops, whereby the inner sides of the hoops are rotatable in a range of a certain degree.

The nose support of the connecting frame is enveloped by soft material for comfortable touch feeling.

DESCRIPTION OF THE PREFERRED EMBODIMENTS

Figure 1:
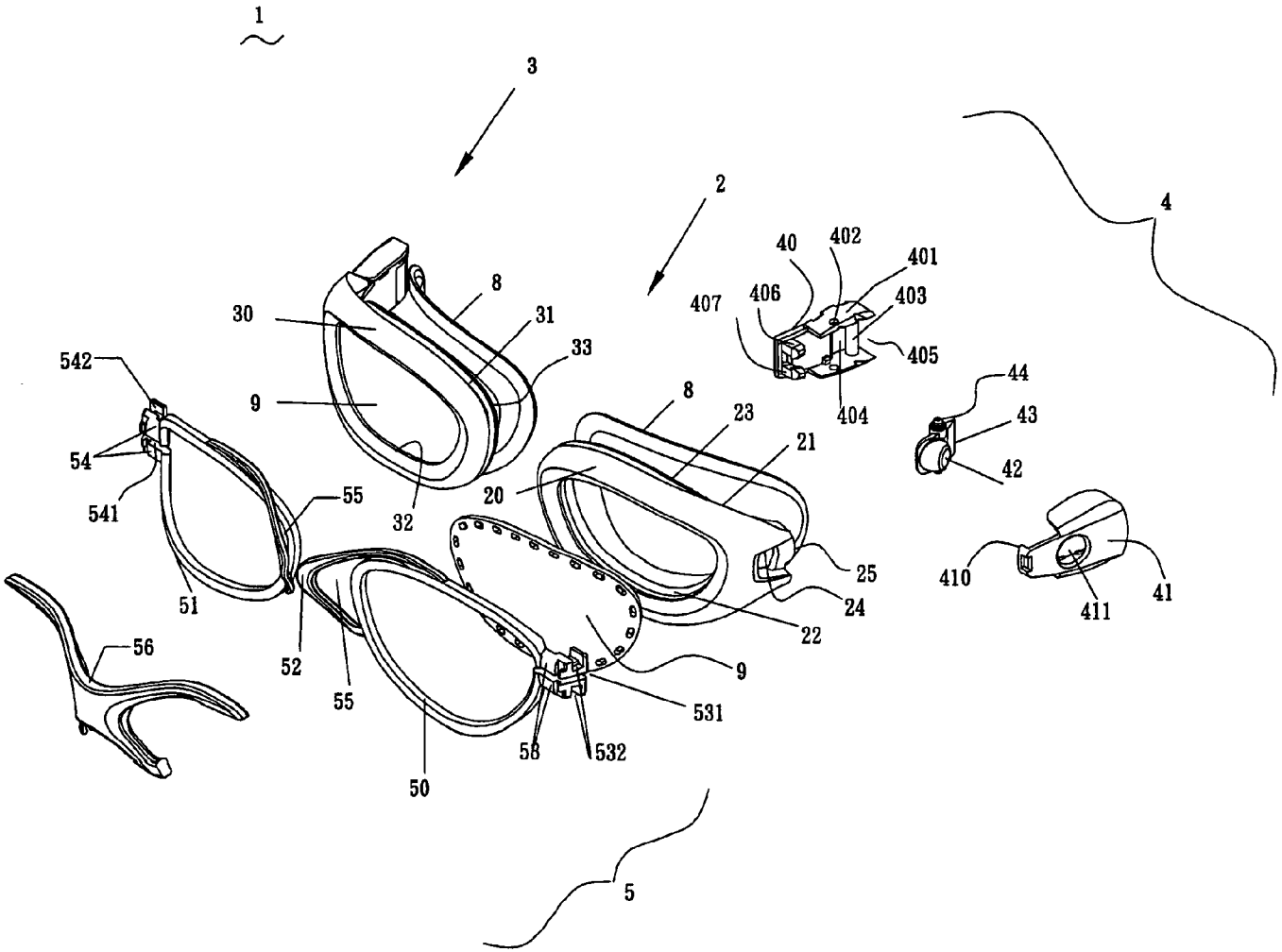
FIG. 1 is an exploded view of swimming goggles fo the present invention.
Figure 2:
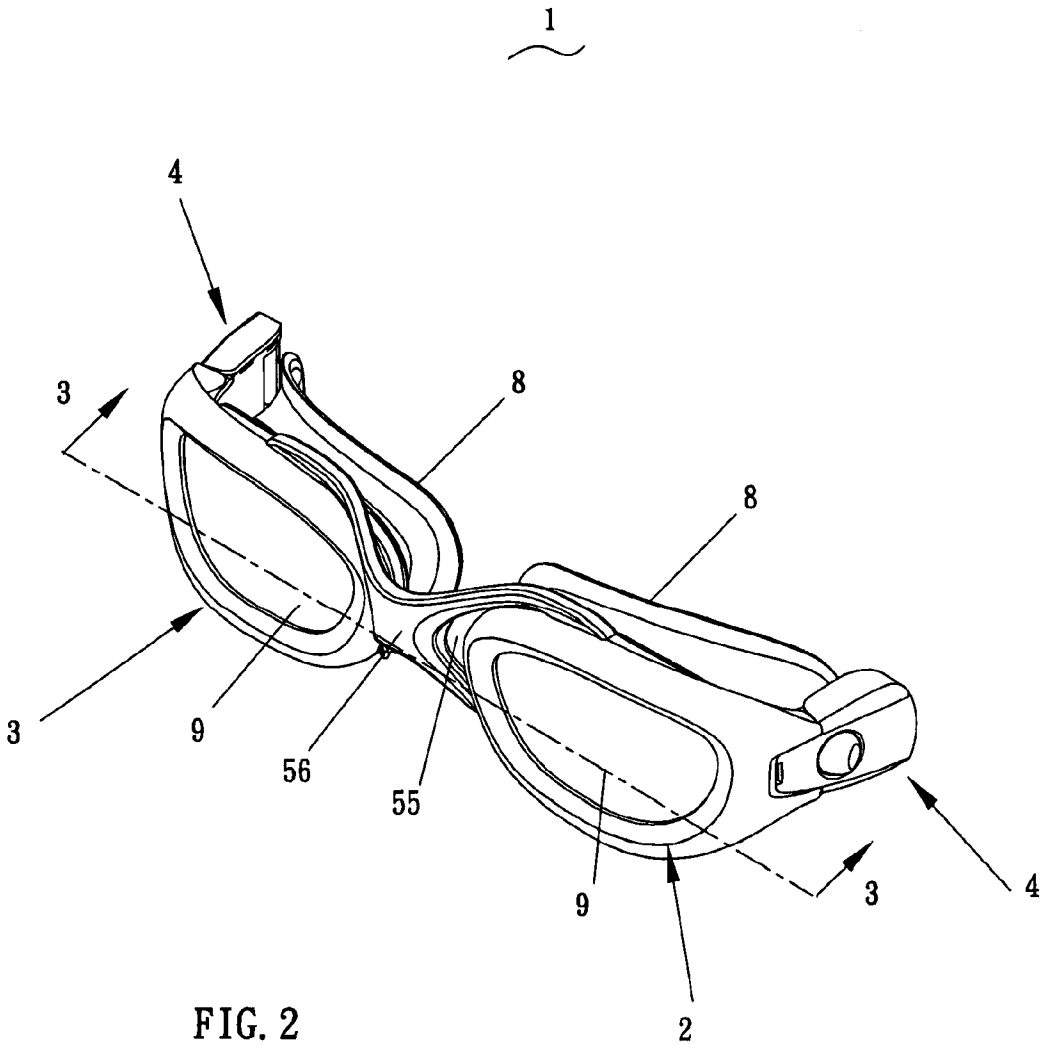
FIG. 2 is an assembled view of the swimming goggles of FIG. 1.
Figure 3:
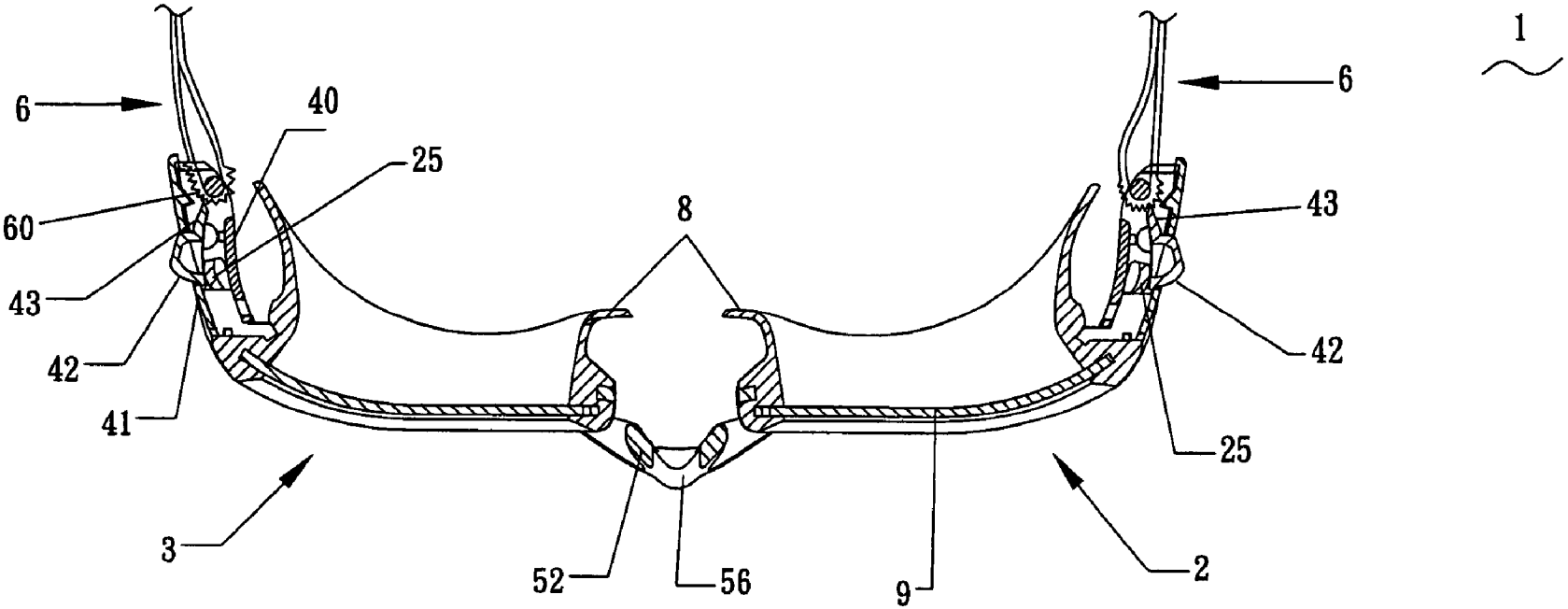
FIG. 3 is cross-sectional view taken along w\the line 3—3 of FIG. 2.
Figure 4:
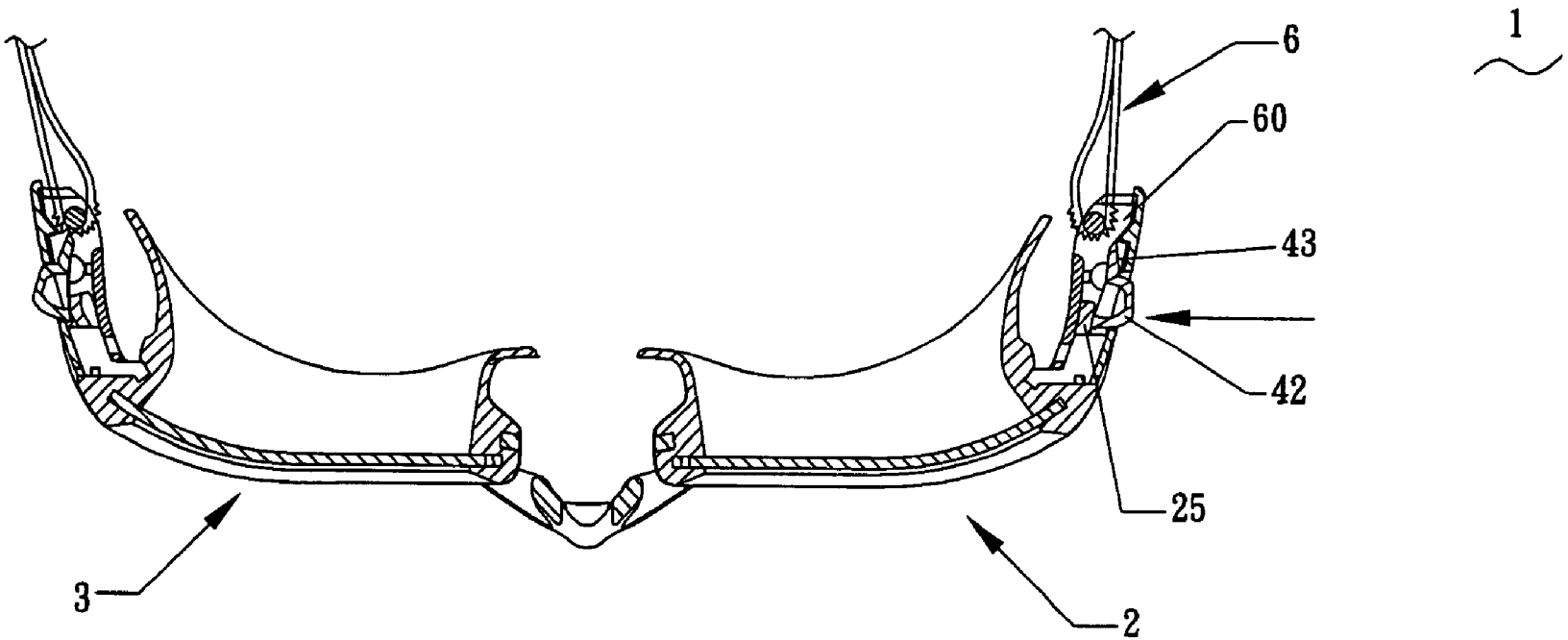
FIG. 4 shows a head fastener being the button of the adjusting apparatus being pressed inwardly to loosen the head fastener.
Figure 6A:
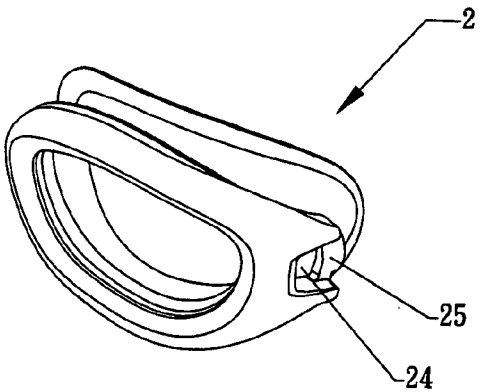
FIGS. 6A–6C are respectively an assembled view, a top view and a back view of frames of the swimming goggles of FIG. 1.
Figure 6C:
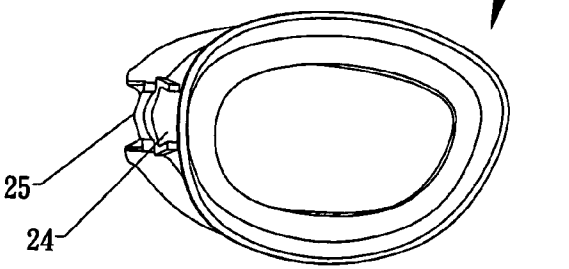
Figure 6B:
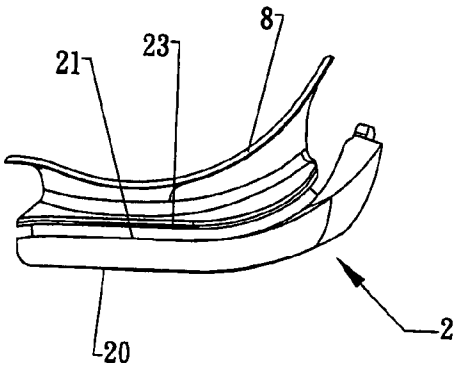

With reference to FIGS. 1 and 2, the swimming goggles 1 include a left frame 2, a right frame 3, adjusting apparatuses 4, a connecting frame 5 and head fasteners 6 (shown in FIGS. 3 and 4). The left and the right frames 2, 3 respectively have outer surfaces 20, 30 and inner surfaces 21, 31. Receiving passages 22, 32 are respectively located between the outer surfaces 20, 30 and the inner surfaces 21, 31 for accommodating lenses 9. The inner surfaces 21, 31 of the left and the right frames 2, 3, respectively have soft pads 8 to provide comfortable touch for the user. In combination to FIG. 6A, embedding holes 23, 33 are respectively located between the left and right frames 2, 3 and proximate the soft pads 8 for receiving the connecting frame 5. Assembled holes 24, 34 are respectively located in outer sides of the left and right frames 2, 3, for receiving the adjusting apparatuses 4. Camber springs 25, 35 respectively project from outer sides of the left and the right frames 2, 3 and on lower edges of the assembling holes 24, 34 for providing return force while being pressed radially, as shown in FIGS. 6B and 6C.

Figure 5:
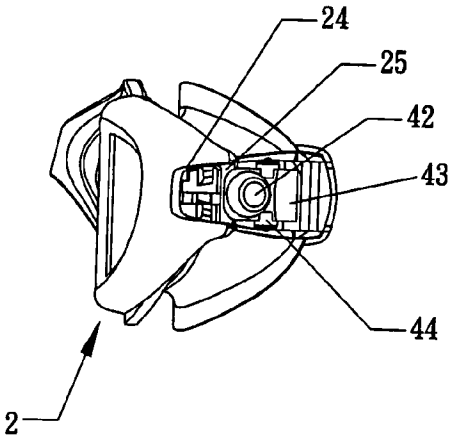
FIG. 5 is a side view of the swimming goggles of FIG. 2, wherein a cover thereof is removed.

The adjusting apparatuses 4 are respectively assembled to the assembled holes 24, 34 of the left and the right frames 2, 3. FIG. 1 shows an exploded view of an adjusting apparatus 4. Each adjusting apparatus 4 is made of hard material and includes a base 40 and a cover 41 integrated together, and a button 42. The button 42 forms a biasing arm 43 and a shaft 44. The base 40 has a shaft block 401, a shaft hole 402 being defined in the shaft block 401 for mounting the shaft 44 thereon. A guiding bar 403 is provided adjacent to the shaft 44 and includes a guide-in hole 404 and a guide-out hole 405 in opposite sides thereof through which a head fastener 6 is pulled. Posts 406, 407 respectively locate near the shaft blocks 401. In assembly the head fastener 6 is pulled from the guide-in hole 404, surrounding the guiding bar 403, and then out of the guide-out hole 405. The cover 41 forms a latch 410 to engage the base 40, and defines a through hole 411 for receiving the button 42. In assembly the button 42 projects slightly beyond the cover 41 for operation. The button 42 and the biasing arm 43 connect with the base 40 and cover 41 according to leverage principle. The distance between the button 42 and the center of shaft 44 is larger compared to the distance between the biasing arm 43 and the center of shaft 44. Thus, the shaft being regarded as a center of the lever, the button 42 can be easily pressed to actuate relative movement of the stop arm 43. Referring to FIGS. 5, 6B and 6C, the button 42 has a portion opposite to a pressed portion thereof and biasing against the camber spring 25 of the left frame 2. The camber spring 25 is pressed and then provides return force to push the button back. Further referring to FIG. 3, the button 42 presses a portion of the camber spring 25, which slantwise projects beyond the cover 41 when assembly, whereby pressing force to the button is controllable.

The connecting frame 5 is made of hard material and includes two hoops 50, 51 and a nose support 52. The hoops 50, 51 are received in the embedding holes 23, 33 of the left and the right frames 2, 3. The hoops 50, 51 respectively have joint blocks 53, 54 on outer sides thereof. Gaps 531, 541 are respectively defined through the joint blocks 53, 54 and are substantially in a middle portion thereof. The joint portions 53, 54 are received in the assembled holes 24, 34 and engage with the adjusting apparatuses 4. The joint blocks 53, 54 respectively define positioning slots 532, 542 opposite to each other, and posts 406, 307 are provided on the bases 40 for corresponding to the positioning slots 532, 542. Thus, the force on the head fasteners 6 is further exerted to the guiding bar 403 and the jointing portion between the posts 406, 407 and the positioning slots 532, 542 but not to the left and the right frames 2, 3, thereby preventing the left and the right frames 2, 3 made of soft material from distortion.

The nose support 52 extends inwardly from upper and lower edges of the hoops 50, 51 and is located between the hoops 50, 51. The nose support 52 is further spaced a distance 55 away from of inner sides of the hoops 50, 51, allowing free rotation of the inner sides of the hoops 50, 51 in a range of a certain degree. Additionally, the nose support 52 is enveloped by soft material 56 for comfortable touch feeling.

Also referring to FIG. 2, in assembly, the buttons 42 of the adjusting apparatuses 4 project slightly slantwise beyond the covers 41. Further referring to FIG. 3, the biasing arms 43 abut against stopping slots 60 of the fasteners 6 at accurate positions. Therefore in use, when the swimming goggles are worn, the fasteners 6 are easily pulled from opposite sides of the left and the right frames 2, 3 for precise positioning. As shown FIG. 4, when the buttons 42 are pressed downward along a right arrow to make the head fasteners 6 looser, according to leverage principle, the biasing arms 43 move upwardly to disengage from the stopping slots 60. At that time the fasteners 6 can be adjusted appropriately. When the buttons 42 are released, the camber springs 25, 35 provide the buttons 42 with return force such that the biasing arms 43 abut against the stopping slots 60.

The nose support 52 is spaced an appropriate distance away from the left and right frames 2, 3, whereas inner sides of the left and the right frames 2, 3 are rotatable freely to cooperate with concave between eyes and a nose of a user thereby overcoming the problem of water leakage and making more comfortable.

It is understood that the invention may be embodied in other forms without departing from the spirt thereof. Thus, the present examples and embodiments are to be considered as illustrative and not restrictive, and the invention is not to be limited to the details given herein.

The invention claimed is:

1. Swimming goggles comprising:

a left frame and a right frame integrated by a connecting frame, each of the left and the right frames having an outer surface and an inner surface, receiving passages being defined between the outer surfaces and inner surfaces for accommodating lenses, at least an assembled hole being respectively defined in outer sides of the left and the right frames, at least an adjusting apparatus assembled to the assembled holes, and each adjusting apparatus including a base and a cover engaged with each other, and a button with a biasing arm, the base having a shaft block, a shaft hole being defined in the shaft block for mounting a shaft therein, a guiding bar being provided adjacent to the shaft and defining a guide-in hole and a guide-out hole in opposite sides thereof, the button and the biasing arm connect with the base and cover complying with leverage principle;

springs for providing return force for buttons; and head fasteners assembled between the bases and the covers and being pulled from the guide-in hole, surrounding the guiding bar and out of the guide-out hole, a plurality of stopping slots being defined for cooperating with the biasing arms of the buttons;

wherein the biasing arms unilaterally engage/disengage stopping slots of the head fasteners, whereas a user directly pulls the head fasteners to make the head fasteners tighter or press the button to make the head fasteners looser.

2. The swimming goggles as claimed in claim 1, wherein the distance between the button and the center of shaft is larger than the distance between the biasing arm and the center of shaft.

3. The swimming goggles as claimed in claim 1, wherein the springs are camber and are formed on the left and the right frames opposite to the buttons, and the springs are pressed to distortion for providing return force when the buttons are pressed downwardly.

4. The swimming goggles as claimed in claim 3, wherein the buttons abut against sides of the camber springs and project slantwise beyond the covers of the apparatuses.

5. The swimming goggles as claimed in claim 1, wherein the guiding bars are integrally formed with the shaft blocks.

6. The swimming goggles as claimed in claim 5, wherein the connecting frame includes two hoops for latching the left and the right frames near the inner surfaces thereof, and a nose support inwardly extending from upper and lower edges of the hoops and between the hoops, and wherein the nose support is spaced a distance away from inner sides of the hoops thereby allowing free rotation of inner sides of the hoops in a range of a certain degree.

7. The swimming goggles as claimed in claim 6, wherein the nose support is enveloped by soft material for the user's comfort.

8. The swimming goggles as claimed in claim 6, wherein the hoops respectively have joint blocks received in the assembled holes of the left and the right frames and integrated with the adjusting apparatuses.

9. The swimming goggles as claimed in claim 8, wherein each joint block defines a gap therethough and substantially in a middle portion thereof.

10. The swimming goggles as claimed in claim 8, wherein the joint blocks respectively define positioning slots, and posts are provided on the bases for corresponding to the positioning slots, whereby the joint blocks engage with the adjusting apparatuses.

11. The swimming goggles as claimed in claim 1, wherein the left and right frames respectively define embedding holes in the inner surfaces thereof and proximate soft pads.

12. Swimming goggles comprising:

a left frame and a right frame integrated by a connecting frame, each of the left and the right frames having an outer surface and an inner surface, receiving passages being defined between the outer surfaces and inner surfaces for accommodating lenses, at least an assembled hole being respectively defined in outer sides of the left and the right frames;

the connecting frame for connecting with the left and the right frames, and including two hoops for latching the left and the right frames near the inner surfaces thereof, and a nose support inwardly extending from upper and lower edges of the hoops and between the hoops, and the nose support being spaced a distance away from inner sides of the hoops thereby allowing free rotation of inner sides of the hoops in a range of a certain degree; and head fastener elements assembled to outer edges of the left and the right frames, and including head fasteners and adjusting apparatuses.

13. The swimming goggles as claimed in claim 12, wherein the nose support is enveloped by soft material for the usere's comfort.

14. The swimming goggles as claimed in claim 12, wherein the hoops respectively have joint blocks received in th assembled holes of the left and the right frames and integrated with the adjusting apparatuses.

15. The swimming goggles as claimed in claim 14, wherein each joint block defines a gap therethough and substantially in a middle portion thereof.

16. The swimming goggles as claimed in claim 14, wherein the joint blocks respectively define positioning slots, and posts are provided on the basis for corresponding to the positioning slots, whereby the joint blocks engage with the adjusting apparatuses.

17. The swimming goggles as claimed in claim 12, wherein the left and right frames respectively define embedding holes in the inner surfaces thereof and proximate soft pads thereof.

* * * * *